US006613968B1

(12) United States Patent
Devereaux et al.

(10) Patent No.: US 6,613,968 B1
(45) Date of Patent: Sep. 2, 2003

(54) GUITAR BRIDGE AND TAILPIECE

(76) Inventors: Sharon C. Devereaux, 9608 Morris Hunter Dr., Oakdale, CA (US) 95361; Kurt O. Laubhan, 710 Columbia Way, Modesto, CA (US) 95350

( * ) Notice: Subject to any disclaimer, the term of this patent is extended or adjusted under 35 U.S.C. 154(b) by 0 days.

(21) Appl. No.: 09/697,529

(22) Filed: Oct. 25, 2000

Related U.S. Application Data

(60) Provisional application No. 60/178,452, filed on Jan. 27, 2000.

(51) Int. Cl.[7] ..... G10D 3/00
(52) U.S. Cl. ..... 84/299; 84/298
(58) Field of Search ..... 84/299, 298, 297 R, 84/301, 302

(56) References Cited

U.S. PATENT DOCUMENTS

| | | | | |
|---|---|---|---|---|
| 1,365,839 A | | 1/1921 | McHugh et al. | |
| 2,714,326 A | | 8/1955 | McCarty | 84/299 |
| 2,740,313 A | | 4/1956 | McCarty | 84/307 |
| 3,237,502 A | | 3/1966 | Moseley | 84/267 |
| 3,440,921 A | | 4/1969 | McCarty | 84/307 |
| 4,069,733 A | | 1/1978 | Quan | 84/299 |
| 4,291,607 A | * | 9/1981 | Kauffman | 84/299 |
| 4,457,201 A | | 7/1984 | Storey | 84/313 |
| 5,497,690 A | | 3/1996 | Soupios | 84/453 |

* cited by examiner

*Primary Examiner*—Kimberly Lockett
(74) *Attorney, Agent, or Firm*—Carr & Ferrell LLP

(57) ABSTRACT

An improved guitar bridge and tailpiece is provided for use in facilitating the tuning and retuning procedure for a guitar. The new guitar bridge and tailpiece each include a setscrew hole at each end of their respective base pieces. The setscrew holes are formed from an outer vertical end to a vertical hole or slot therein. Into each setscrew hole is placed a setscrew which, upon fastening into the setscrew hole, contacts adjustment posts or studs which are mounted to a body of the guitar. By tightening the setscrews against the adjustment posts or studs, the bridge or tailpiece is fixedly mounted to the body of the guitar. Because the bridge and tailpiece remain fixed to the guitar body, once tuned, the strings do not require extensive tuning adjustment each time the strings are replaced.

14 Claims, 4 Drawing Sheets

GUITAR BRIDGE AND TAILPIECE

CROSS-REFERENCE TO RELATED APPLICATION

This application is related to, and claims the benefit of, U.S. Provisional Application Ser. No. 60/178,452, filed on Jan. 27, 2000, and entitled "Guitar Bridge and Tailpiece," which is herein incorporated by reference.

BACKGROUND OF THE INVENTION

1. Field of the Invention

This invention relates to guitar bridges and tailpieces and more particularly to rigidly mounted guitar bridges and tailpieces that become fixedly mounted to the body of a guitar.

2. Description of Related Art

Steel string guitars generally have four separate structures in the string system. These four structures must be carefully installed and aligned for the strings to accurately reproduce the desired notes upon being plucked or strummed.

Referring to FIG. 1, a tailpiece 100 is mounted on a body of a guitar and holds one end of strings 102, 104, 106, 108, 110, and 112. The tailpiece 100 provides the mechanical strength for the tension of the stretched strings against the body of the guitar. These strings 102, 104, 106, 108, 110, and 112 then pass over a bridge 120 which is used to initially set the tuning of the guitar so the guitar plays in tune with the proper tone and timbre. In an electric guitar, the strings 102, 104, 106, 108, 110, and 112 will also pass over one or more magnetic or other types of pickups 130. The pickups 130 are used to convert the physical vibrations of the strings 102, 104, 106, 108, 110, and 112 into electrical energy which can then be electrically amplified.

The strings 102, 104, 106, 108, 110, and 112 then extend over, but do not contact, multiple frets, not shown, on the guitar. Towards a neck of the guitar the strings 102, 104, 106, 108, 110, and 112 then pass over a nut to tuning pegs. The tuning pegs are adjustable to increase or decrease the tension of the strings 102, 104, 106, 108, 110, and 112 in relation to each other. This raises or lowers the frequency of the tone of each string so that the proper notes are heard upon plucking or strumming the guitar. Between the nut and the bridge 120 are the various frets between which the strings 102, 104, 106, 108, 110, and 112 are depressed so that the effective length of the string is shortened to thereby increase the frequency at which that particular string vibrates.

An important factor in a quality electric guitar is the guitar sound. The material of the body, the quality of the magnetic or other pickups, the rigidity of the guitar itself, the accuracy of the placement and spacing of the strings 102, 104, 106, 108, 110, and 112 above the fingerboard and associated frets, the actual placement of the frets, and the quality of the tuning bridge 120 are all important to the overall sound of the guitar.

The strings 102, 104, 106,108, 110, and 112 are stretched initially between the bridge 120 and the nut just to tune the strings 102, 104, 106, 108, 110, and 112 to their proper respective note. Then the strings 102, 104, 106, 108, 110, and 112 are stressed further by a guitar player, upon playing, by forcing the strings 102, 104, 106, 108, 110, and 112 down onto the fingerboard between frets. Because of the energy with which some players play their guitars, the strings 102, 104, 106, 108, 110, and 112 stretch and often have to be replaced daily or even while playing. This requires that the strings 102, 104, 106, 108, 110, and 112 be removed from the tuning pegs, the body of the guitar, and the tailpiece 100, respectively.

Since the bridge 120, and possibly the tailpiece 100, are only held down by the tension of the strings 102, 104, 106, 108, 110, and 112, the replacement of the strings 102, 104, 106, 108, 110, and 112 requires that the entire guitar be completely retuned every time a string or strings are replaced. This requires a very fine ear by the guitar tuner. Alternatively, s/he must utilize separate tuning equipment to reset the guitar bridge 120 and the tuning ramps (known as "saddles") on the bridge 120. In fact, when the guitar strings 102, 104, 106, 108, 110, and 112 are removed, the bridge 120 becomes freely removable. If the tuning person is not careful, the bridge 120 and other components may fall off the guitar and possible mar the guitar body. Further, without a complete retuning and adjustment of the guitar, the guitar will not play well, stay in tune, or resonate well. A complete readjustment of all the components of the guitar is typically required after every loosening and/or removal of strings for simple operations such as cleaning and simple maintenance, taking much time and effort to return it to a playable condition. Therefore, there is a need for an improved system and method for securing a bridge and tailpiece to the guitar.

SUMMARY OF THE INVENTION

The present invention provides an improved system and method for securing a bridge and tailpiece to a guitar. The system includes a bridge having a long, narrow base piece with top, bottom, front, and rear surfaces. There is a vertical alignment hole at each end of the base piece formed from the top surface through the bottom surface. The bridge also includes a setscrew hole in each end of the base piece which is formed from an outer vertical edge through the base piece to each vertical alignment hole. The guitar bridge also provides for a setscrew to be inserted into each of the setscrew holes, the setscrews being rotated into the base piece and into contact with adjustment posts placed into the vertical alignment holes to fixedly mount the guitar bridge to the adjustment posts.

The present invention also includes a tailpiece having a long, narrow base piece with top, bottom, front, and rear surfaces. The base piece includes string holes in the base piece formed from the front surface through the rear surface. A vertical alignment hole or slot is provided at each end of the base piece formed from the top surface through the bottom surface. A setscrew hole is also provided in each end of the base piece extending from the outer vertical edges through the base piece to each vertical hole or slot. The guitar tailpiece also provides for a setscrew inserted into each of the setscrew holes. The setscrews are rotated into the base piece and into contact with adjustment posts placed in the vertical hole or slot to fixedly mount the guitar bridge to the adjustment posts.

The invention includes a method of mounting a guitar bridge to a guitar comprising fastening adjustment posts to a body of the guitar, placing the guitar bridge on the adjustment posts such that the adjustment posts are inserted into vertical alignment holes at each end of a base piece, and fastening setscrews into the base piece so that the setscrews contact the adjustment posts to fixedly mount the guitar bridge to the guitar.

In an alternative embodiment of the tailpiece, the string holes include slots which extend from the string holes to the bottom surface. These slots allow guitar strings to be slipped out through the bottom surface rather than being completely withdrawn through the string holes.

BRIEF DESCRIPTION OF THE DRAWINGS

For a more complete understanding of the invention, as well as other objects and further features thereof, reference may be had to the following detailed description of the invention in conjunction with the drawings wherein.

Reference numbers refer to the same or equivalent parts of the present invention throughout the various figures of the drawings.

DETAILED DESCRIPTION OF THE INVENTION

The present invention relates to an improved guitar bridge and tailpiece for use in facilitating the tuning and retuning procedure for a guitar that requires a new string or strings, and also for improving the sound from the guitar by creating a more solidly mounted system for coupling the strings to a resonating guitar body. The solid connection afforded by the disclosed invention allows for the guitar instrument to resonate better, thus transferring the sound to the instrument body and enhancing the played notes. The sound quality is also enhanced due to the solid adjustment of the bridge components allowing for increased harmonic overtone transfer to the instrument pickups. After adjustment, as described hereinafter, the components are secured and cannot come loose even when the strings are removed, thereby preventing any damage to the instrument finish. Also, since the adjustments are secured, there is no need to readjust the string components after string removal, as the components do not come off or loosen during the string replacement process.

The components described herein are also designed to fit or retrofit most instruments without any modification to the original instrument. Even expensive "vintage" instruments can be fitted with the new components without any modification to the instrument, and the use of the new components does not detract from the "vintage" look of the instrument. The new components may be constructed to make visual detection of any difference between original stock components and the new components difficult. The new components are easy to use, install, and adjust by a purchaser. A professional installation and adjustment of the components is likely not needed after the first such installation and adjustment, as the instrument owner or user can perform the installation and maintenance.

Figure 1:
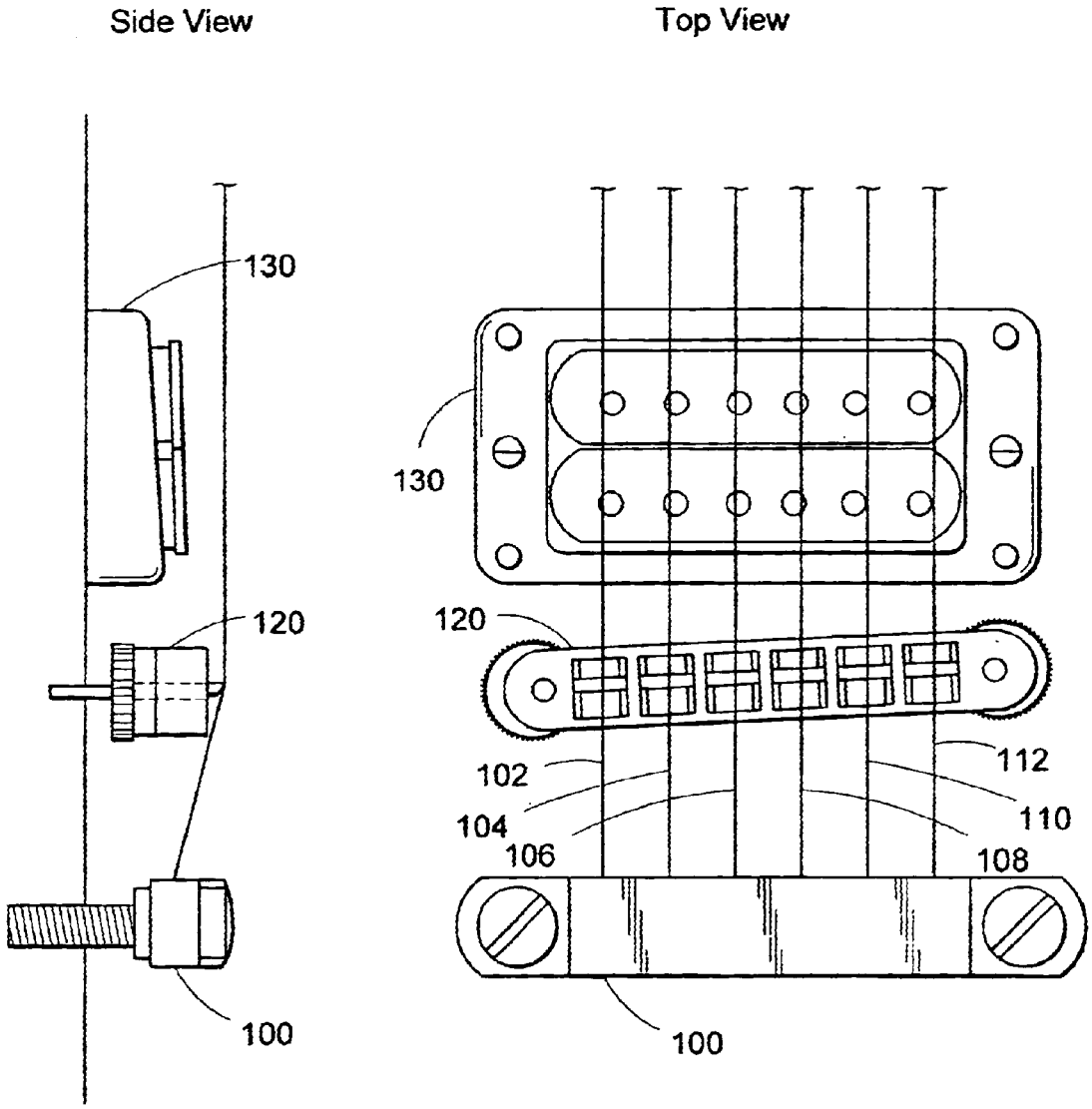
FIG. 1 is a top and side view of a conventional guitar upon which a guitar bridge and a tailpiece have been mounted.
Figure 2:
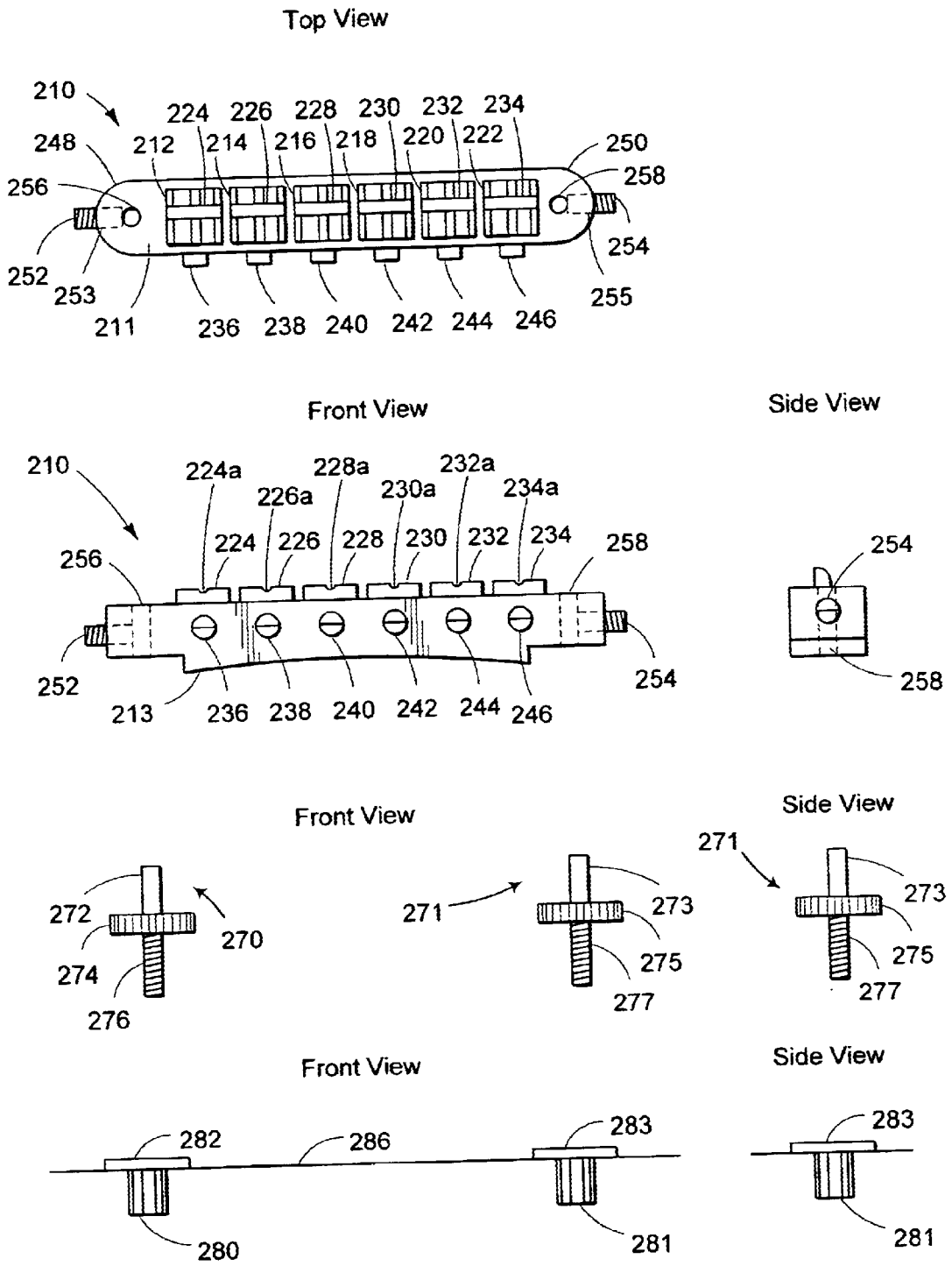
FIG. 2 is a top and front view of a guitar bridge and associated parts of a standard electric guitar, according to the present invention.

Referring now to FIG. 2, top and front views of an improved guitar bridge 210 are shown. The guitar bridge 210 comprises a long and narrow base piece that is formed of standard metal, such as steel or brass. A top surface 211 is preferably, generally flat; while a bottom surface 213 is preferably, generally concave to match the curvature of a guitar 286. Alternatively, the top and bottom surfaces 211 and 213 may consist of other shapes. Cut or formed in the bridge 210 are several square or rectangular holes 212, 214, 216, 218, 220, and 222 extending from the top surface 211 through the bottom surface 213. Vertically through each end of the bridge 210 are vertical alignment holes 256 and 258 extending from the top surface 211 to the bottom surface 213. Also formed on rounded edges 248 and 250 of the bridge 210 are two threaded setscrew holes 253 and 255 extending from tips of the edges 248 and 250 to the vertical alignment holes 256 and 258. Setscrew 252 and 254 are placed into each threaded setscrew hole 253 and 255, respectively, in the ends of the bridge 210.

In each of the square or rectangular holes 212, 214, 216, 218, 220, and 222 are shoulder wedges 224, 226, 228, 230, 232, and 234 which are formed with a threaded hole through the body of each shoulder wedge 224, 226, 228, 230, 232, and 234. Adjustment screws 236, 238, 240, 242, 244, and 246 pass through the threaded holes in each shoulder wedge 224, 226, 228, 230, 232, and 234.

Adjustment posts 270 and 271 are generally rounded longitudinal elements which are threaded on a bottom section 276 and 277 and smooth along an upper section 272 and 273. These adjustment posts 270 and 271 are fixedly mounted on the guitar body at the factory or at the store from which the guitar 286 is purchased. Circular adjustment wheels 274 and 275 are made with threaded holes through the center of each wheel 274 and 275. These threaded holes are mated with the adjustment posts 270 and 271. Alternatively, the adjustment wheel 274 and 275 may be constructed in one piece with the adjustment posts 270 and 271.

When the guitar 286 is assembled, the adjustment posts 270 and 271 are placed into holes drilled or otherwise formed in the body of the guitar 286. In one embodiment, a glue or other adhesive is placed in the drilled holes and on the bottom sections 276 and 277 of the adjustment posts 270 and 271 which permanently mounts the posts 270 and 271 to the guitar body. This procedure is commonplace in the guitar industry and any known glue or adhesive may be used as would be known to a guitar practitioner in the art. Alternatively, the adjustment posts 270 and 271 may be pounded into the holes with a mallet or similar device to form a tight friction bond. In yet another embodiment, the adjustment posts 270 and 271 may be screwed into holes 282 and 283 in grommets 280 and 281 which are permanently mounted in the body of the guitar 286. Using grommets 280 and 281 would allow the adjustment posts 271 and 272 to be easily replaced, although this is rarely necessary. The adjustment posts 270 and 271 are then rotated up or down along the threaded bottom sections 276 and 277 to adjust the height of the bridge 210 above the guitar body.

After the adjustment posts 271 and 272 are mounted in the guitar body, the guitar bridge 210 is placed over the adjustment posts 270 and 271 and rests on upper surfaces of each adjustment wheel 274 and 275. Even though the posts 270 and 271 and alignment holes 256 and 258 in the bridge 210 are manufactured with close tolerances, the bridge 210 is not yet fixedly mounted to the posts 271 and 272. The setscrews 252 and 254 are now placed in the setscrew holes 253 and 255. Alternatively, the setscrews 252 and 254 may be placed in the setscrew holes 253 and 255 before the bridge was placed on the adjustment wheels 270 and 271. In either embodiment, the setscrews 252 and 254 are fastened into the setscrew holes 253 and 255. After a few turns of the setscrews 252 and 254, the setscrews 252 and 254 come into contact with the upper sections 272 and 273 of the adjustment posts 270 and 271. If the height of the bridge 210 above the strings or surface of the guitar 286 has been adequately adjusted to meet the preference of the player, the setscrews 252 and 254 are tightened against the upper sections 272 and 273 of the adjustment posts 270 and 271. This tightening action will fixedly mount the bridge 210 to the adjustment posts 270 and 271. The guitar strings can now be properly tuned on the guitar 286.

The adjustment screws 236, 238, 240, 242, 244, and 246 in the square or rectangular openings 212, 214, 216, 218, 220, and 222 are now adjusted to tune the strings to the particular guitar 286. In one embodiment, the guitar shoulder wedges 224, 226, 228, 230, 232, and 234 may include a small notch 224*a*, 226*a*, 228*a*, 230*a*, 232*a*, and 234*a* on which the strings may rest. This forms a virtual end of the string for tuning and playing purposes. The adjustment screws 236, 238, 240, 242, 244, and 246 can be adjusted to move the shoulder wedge 224, 226, 228, 230, 232, and 234 along the adjustment screws 236, 238, 240, 242, 244, and 246 within the rectangular holes 212, 214, 216, 218, 220, and 222. Since each string passes over a separate shoulder wedge 224, 226, 228, 230, 232, and 234, each string is individually adjustable. Each adjustment screw 236, 238, 240, 242, 244, and 246 is closely manufactured to snugly fit within each adjustment screw hole, so there is little or no play between each adjustment hole and screw 236, 238, 240, 242, 244, and 246. Thus, once a shoulder wedge 224, 226, 228, 230, 232, and 234 has been adjusted to each guitar string, it should need little or no future adjustment. At this point the guitar 286 has adjusted shoulder wedges 224, 226, 228, 230, 232, and 234 on a guitar bridge 210 which is now fixedly mounted to the guitar 286, and which will not fall or come off when strings are replaced.

Figure 3:
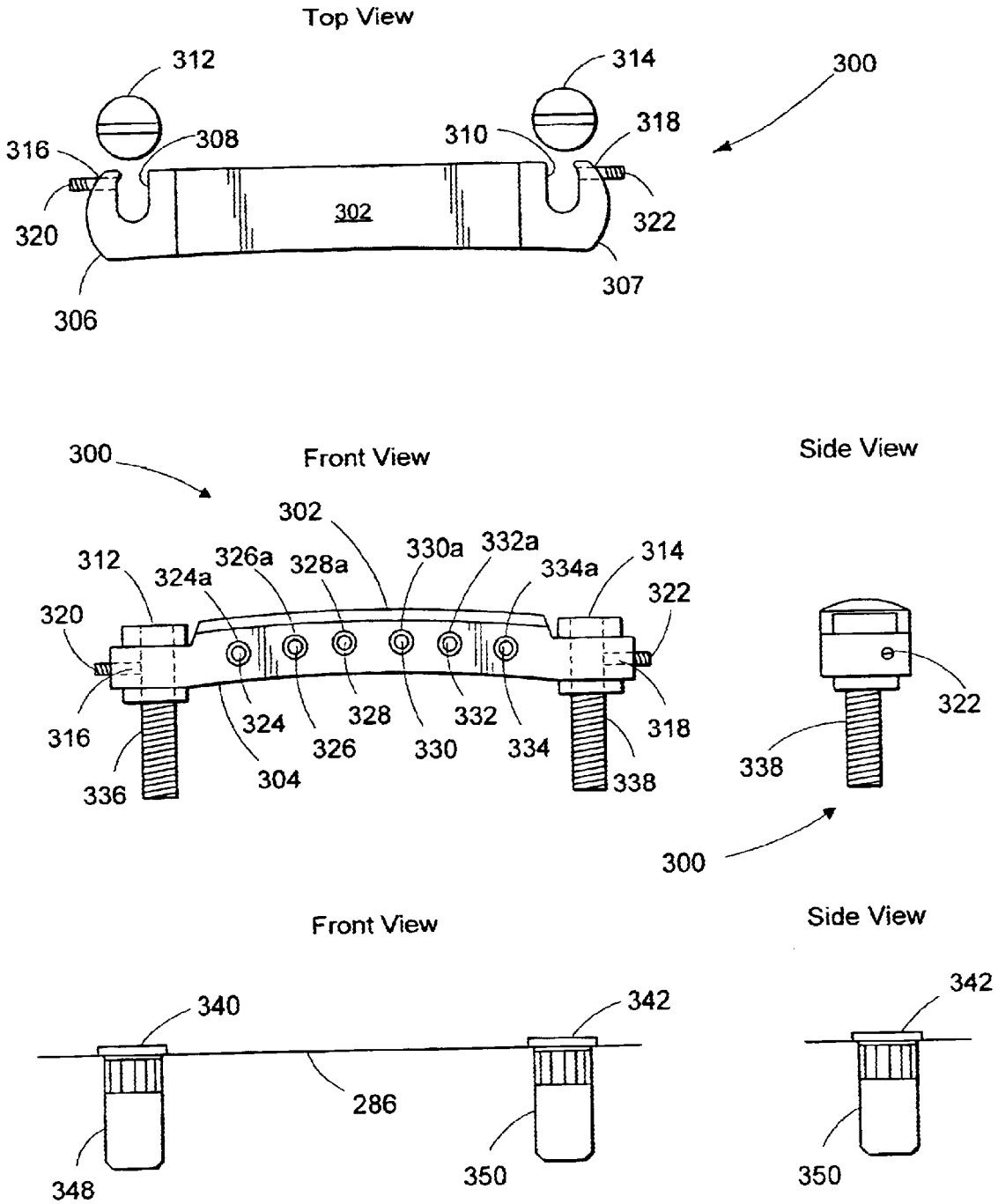
FIG. 3 is a top and front views of a guitar tailpiece and associated parts of a standard electric guitar, according to the present invention.

Referring now to FIG. 3, top and front views of a new guitar tailpiece 300 are shown. The guitar tailpiece 300 comprises a long and narrow base piece that is formed of standard metal, such as steel or brass. A top 302 and bottom 304 surfaces of the tailpiece 300 are generally curved in order to aesthetically match the surface curve of a guitar 286 upon which the tailpiece 300 is to be mounted. Several longitudinal string holes 324, 326, 328, 330, 332, and 334, generally evenly spaced apart along the width of the tailpiece 300, are formed or machined through the tailpiece 300. These string holes 324, 326, 328, 330, 332, and 334 also have indentations 324*a*, 326*a*, 328*a*, 330*a*, 332*a*, and 334*a* of a slightly larger diameter on both the front and rear entries of the string holes 324, 326, 328, 330, 332, and 334. These larger indentations 324*a*, 326*a*, 328*a*, 330*a*, 332*a*, 334*a* are formed in the tailpiece 300 to accommodate small balls which are manufactured at the ends of steel strings used in some guitars. These strings are placed through longitudinal holes 324, 326, 328, 330, 332, and 334 towards the bridge 210 (FIG. 2) and nut of the guitar 286, not shown. It is these balls on the ends of the strings which absorb all of the tension on the strings after top ends of the strings are mounted on tuning screws on a neck of the guitar 286.

Vertical holes or slots 308 and 310 are formed on each end of the tailpiece 300. These vertical slots or holes 308 and 310 are typically round and extend from the top surface 302 through the bottom surface 304, and accommodate adjustment studs 312 and 314 upon which the tailpiece 300 is mounted.

The adjustment studs 312 and 314 are generally rounded longitudinal elements having threaded lower sections 336 and 338. The upper sections of the stud 312 and 314 are typically of a larger diameter than the lower sections 336 and 338 except for a distance along a middle portion of the upper sections which is formed of a smaller diameter to receive the vertical holes or slots 308 and 310. Since the vertical holes or slots 308 and 310 closely match the diameter of the smaller middle portion of the studs 312 and 314, the vertical holes or slots 308 and 310 provide an upper and lower dimension for maintaining the tailpiece 300 in a snug fit on the adjustment studs 312 and 314.

Longitudinally through the tailpiece 300 are small threaded setscrew holes 316 and 318 formed through outer edges 306 and 307 into the vertical holes or slots 308 and 310 in the tailpiece 300. A setscrew 320 and 322 is placed in each of these small threaded setscrew holes 316 and 318. By fastening the setscrews 320 and 322 into the setscrew holes 316 and 318 and contacting the middle portion of the adjustment studs 312 and 314, these setscrews 320 and 322 fixedly mount the tailpiece 300 to the adjustment studs 312 and 314. This tightening action maintains the tailpiece 300 on the adjustment studs 312 and 314 until the setscrews 320 and 322 are loosened.

The adjustment studs 312 and 314 are generally of a larger diameter or size than the adjustment posts 270 and 271 for the guitar bridge 210 of FIG. 2. This larger size or dimension is necessary because the tailpiece 300 absorbs the majority, if not all, of the tension of the strings upon mounting of the tailpiece 300 to the guitar body 286. The tailpiece 300 and adjustment studs 312 and 314 must be of a size and strength to handle the large tension placed on the tailpiece 300 and adjustment stud 312 and 314 combination by the six or more tuned and stretched strings. The adjustment studs 312 and 314 are, upon guitar assembly, placed into holes drilled or otherwise formed in the body of the guitar 286. Similarly, a glue or other adhesive may be placed in the holes and on the bottom portions of the adjustment studs 312 and 314 which permanently mount the adjustment studs 312 and 314 to the guitar body. This procedure is common, and any known glue or adhesive may be used as would be known to a guitar practitioner in the art. Alternatively, the adjustment studs 312 and 314 may be fastened into holes 340 and 342 in grommets 348 and 350 which may be permanently mounted in the body of the guitar 286. Using grommets 348 and 350 would allow the adjustment studs 312 and 314 to be easily replaced.

After the adjustment studs 312 and 314 are mounted in the guitar body, the guitar tailpiece 300 is guided into the narrower middle portion of the adjustment studs 312 and 314 if vertical slots 308 and 310 are formed on the tailpiece 300. Alternatively, the tailpiece 300 may be placed over the studs 312 and 314 if the tailpiece 300 contains vertical holes instead of slots 308 and 310. Even though the adjustment studs 312 and 314 and slots 308 and 310 on the tailpiece 300 are manufactured with close tolerances, the tailpiece 300 is not yet fixedly mounted to the adjustment studs 312 and 314. The setscrews 320 and 322 are placed in the setscrew holes 316 and 318 in the tailpiece 300 at this time, or before the tailpiece 300 was placed on the adjustment studs 312 and 314. These setscrews 320 and 322 are now fastened into the setscrew holes 316 and 318 in the tailpiece 300. After a few turns of the setscrews 320 and 322, the forward ends of the setscrews 320 and 322 come into contact with the narrow diameter of the middle portion of the adjustment studs 312 and 314. The setscrews 320 and 322 are subsequently tightened against the middle portion of the adjustment studs 312 and 314 to fixedly mount the tailpiece 300 to the adjustment studs 312 and 314.

With the tailpiece 300 and bridge 210 fixedly mounted to the guitar body, the strings can now be tuned, and will remain in tune even if one or more strings are replaced. The fixedly mounted bridge 210 and tailpiece 300 maintain the string relationship even after complete restringing.

Figure 4:
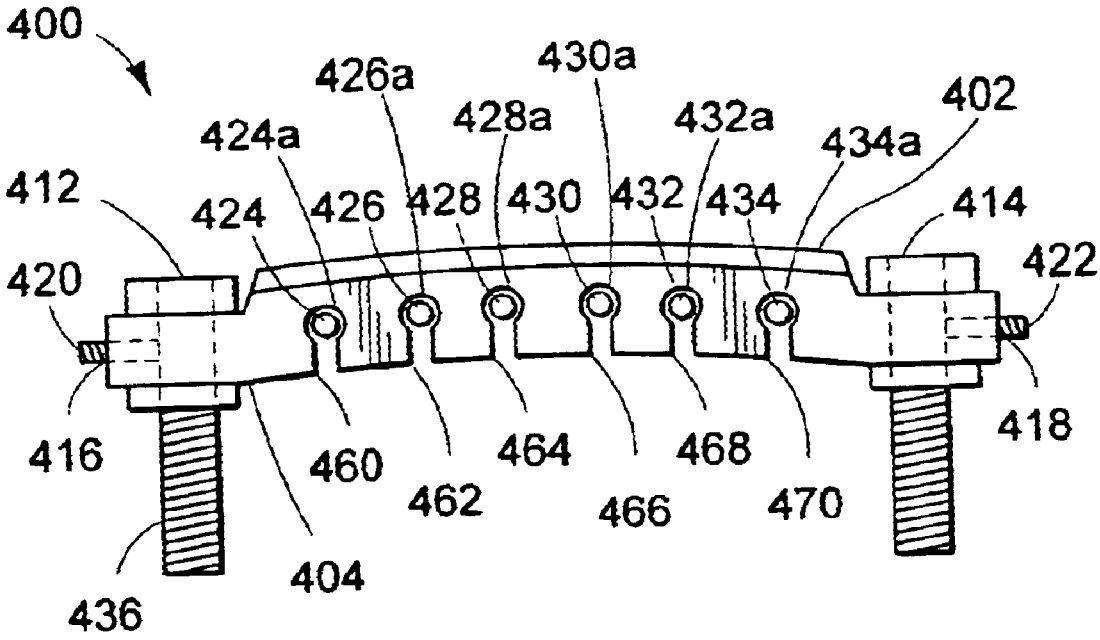
FIG. 4 is a front view of an alternative tailpiece for use with the guitar.

An alternative tailpiece 400 is illustrated in FIG. 4. This tailpiece 400 is similar to the tailpiece 300 of FIG. 3. The difference is that the longitudinal string holes are now expanded to include slots 460, 462, 464, 466, 468, and 470. The slots 460, 462, 464, 466, 468, and 470 extend from the longitudinal string holes 424, 426, 428, 430, 432, and 434 to a bottom 404 of the tailpiece 400 which allow the strings to be slipped out through the bottom 404 of the tailpiece 400 rather than being completely withdrawn through the longitudinal string holes 424, 426, 428, 430, 432, and 434, as required with the embodiment of FIG. 3. The slots 460, 462, 464, 466, 468, and 470 do not affect the rigidity and strength of the tailpiece 400, but add to the ease with which the string or strings can be replaced. Since the tailpiece 400 is fixedly, but removably, attached to the body of the guitar 286, the individual strings can be quickly and effectively replaced, as during a concert, for example, to maintain the string relationship for tone, and reverberation effects, etc.

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention.

What is claimed is:

1. A guitar bridge comprising:

a long, narrow base piece with top, bottom, front, and rear surfaces;

a vertical alignment hole at each end of said base piece, said vertical alignment hole being formed from the top surface through the bottom surface;

a first and second adjustment post configured to fit in the vertical alignment holes;

a setscrew hole in each end of said base piece being formed from an outer vertical edge to each vertical alignment hole; and a setscrew configured for insertion into each of the setscrew holes, the setscrews upon rotation thereof into the base piece and into contact with the adjustment posts fixedly mounts the guitar bridge to the adjustment posts.

2. The guitar bridge of claim 1 wherein each of the adjustment posts further comprise an adjustment wheel, the base piece resting on the adjustment wheel such that rotation of the adjustment wheels adjusts the vertical position of said base piece with respect to the adjustment posts and whereby positioning the setscrews against the adjustment posts fixedly establishes the position of the base piece with respect to each of the adjustment wheels.

3. The guitar bridge of claim 1 wherein the vertical alignment holes are round the entire distance through the base piece, and the adjustment posts are cylindrically round to snugly fit within the vertical alignment holes.

4. The guitar bridge of claim 1 wherein the setscrew holes and the setscrews are threaded so that the threaded setscrews are snugly mated with the thread setscrew holes.

5. The guitar bridge of claim 1 wherein the adjustment posts are mounted to a body of the guitar.

6. A guitar tailpiece comprising:

a long, narrow base piece with top, bottom front, and rear surfaces and having string holes being formed from the front surface through the rear surface;

a vertical hole or slot at each end of the base piece, the vertical holes or slots being formed from the top surface through the bottom surface;

a first and second adjustment stud configured to fit in each of the vertical holes or slots;

a setscrew hole in each end of the base piece being formed from an outer vertical edge to each vertical hole or slot; and a setscrew configured for insertion into each end of the setscrew hole, the setscrew upon rotation thereof into the base piece and into contact with the adjustment studs fixedly mounts the tailpiece to the adjustment studs.

7. The guitar tailpiece of claim 6 wherein the adjustment studs are mounted to a body of the guitar.

8. The guitar tailpiece of claim 6 wherein the initial dimension of the string holes is of a larger diameter than the string holes, the larger diameter receiving a balled end of a standard guitar string.

9. The guitar tailpiece of claim 6 wherein the string holes further comprise slots extending from the string holes to the bottom surface.

10. A method for mounting an improved guitar bridge to a guitar comprising the steps of:

mounting adjustment posts to a body of the guitar;

placing the bridge on the adjustment posts such that the adjustment posts are inserted into a vertical alignment hole at each end of a base piece of the bridge, the adjustment posts further comprising adjustment wheels, the base piece resting on the adjustment wheels;

rotating the adjustment wheels to raise or lower the adjustment wheels and thereby adjust vertical spacing of the bridge in relation to the body of the guitar; and fastening setscrews into setscrew holes in the base piece until the setscrews contact the adjustment posts to fixedly mount the bridge to the guitar.

11. The method of claim 10 wherein the step of mounting further includes placing the adjustment posts into grommets attached to the guitar.

12. The method of claim 10 wherein the step of mounting further includes gluing the adjustment posts to holes in the body of the guitar.

13. A method for mounting an improved guitar tailpiece to a guitar comprising the steps of:

mounting adjustment studs to a body of the guitar by placing the adjustment studs into grommets which are glued to holes in the body of the guitar;

placing the tailpiece on the adjustment studs such that the adjustment studs are inserted into a vertical hole or slot at each end of a base piece of the tailpiece; and fastening setscrews into the base piece such that the setscrews contact the adjustment studs to fixedly mount the tailpiece to the guitar.

14. An improved guitar bridge and tailpiece combination comprising:

a bridge further comprising a long, narrow base piece with top, bottom, front, and rear surfaces; a vertical alignment hole at each end of said base piece, said vertical alignment hole being formed from the top surface through the bottom surface; a first and second adjustment post configured to fit in the vertical alignment holes; a setscrew hole in each end of said base piece being formed from an outer vertical edge to each vertical alignment hole; and a setscrew configured for insertion into each of the setscrew holes, the setscrews upon rotation thereof into the base piece and into contact with the adjustment posts fixedly mounts the guitar bridge to the adjustment posts; and a tailpiece further comprising a long, narrow base piece with top, bottom, front, and rear surfaces and having string holes being formed from the front surface through the rear surface; a vertical hole or slot at each end of the base piece, the vertical holes or slots being formed from the top surface through the bottom surface; a first and second adjustment stud configured to fit in each of the vertical holes or slots; a setscrew hole in each end of the base piece being formed from an outer vertical edge to each vertical hole or slot; and a setscrew configured for insertion into each end of the setscrew holes, the setscrew upon rotation thereof into the base piece and into contact with the adjustment studs fixedly mounts the tailpiece to the adjustment studs.

* * * * *